United States Patent [19]

Roth et al.

[11] Patent Number: 4,713,894

[45] Date of Patent: Dec. 22, 1987

[54] AUTOMATED DRYER CONTROL SYSTEM

[75] Inventors: Philip M. Roth, Garfield; Nathan M. Itskovitch, Hillsdale; Arthur Sussman, Alpine, all of N.J.

[73] Assignee: Intraspec, Inc., Bogota, N.J.

[21] Appl. No.: 638,416

[22] Filed: Aug. 7, 1984

[51] Int. Cl.[4] ..... F26B 21/10

[52] U.S. Cl. ..... 34/30; 34/48; 34/53; 34/55

[58] Field of Search ..... 34/30, 48, 53, 55

[56] References Cited

U.S. PATENT DOCUMENTS

| | | | |
|---|---|---|---|
| 3,210,862 | 10/1965 | Lycan | 34/48 |
| 3,254,423 | 6/1966 | Ruelle | 34/48 |
| 3,309,783 | 3/1967 | Worst | 34/48 |
| 3,882,613 | 5/1975 | Wilson | 34/48 |
| 3,942,265 | 3/1976 | Sisler et al. | 34/48 |
| 4,019,259 | 4/1977 | Veraart | 34/53 |
| 4,206,552 | 6/1980 | Pomerantz et al. | 34/55 |
| 4,267,643 | 5/1981 | Haried | 34/48 |
| 4,412,389 | 11/1948 | Kruger | 34/48 |
| 4,469,026 | 9/1984 | Irwin | 400/126 |
| 4,517,430 | 5/1985 | Slottag | 219/10.55 B |
| 4,520,576 | 6/1985 | Vander Molen | 34/45 |

*Primary Examiner*—Larry I. Schwartz
*Assistant Examiner*—David W. Westphal
*Attorney, Agent, or Firm*—Lerner, David, Littenberg, Krumholz & Mentlik

[57] ABSTRACT

A system for automatically controlling the operation of a dryer, periodically produces signals representative of the present temperature of a load to be dried. Heat is applied to the load in response to the signals representative of the present temperature of the load. A circuit determines a time interval for the load to reach one predetermined temperature from another predetermined temperature. That time interval is representative of the present condition of the load. The dryer is shut off when the present condition of the load reaches a predetermined desired condition.

27 Claims, 9 Drawing Figures

AUTOMATED DRYER CONTROL SYSTEM

BACKGROUND OF THE INVENTION

The present invention is related generally to dryers and more specifically to clothes dryers.

Dryers found in the prior art are manually operated by setting a timer which determines the time during which heat is applied to a load to be dried. Often with such dryers, the load is dried before the period set by the timer has elapsed. This causes the dryer to continue to operate even though the clothes are already dried. Such operation represents an inefficient use of the dryer and is extremely wasteful of energy.

Similarly, the time set by the timer may elapse even though the clothes are not fully dried. The operator will not know that the clothes are not dried until he inspects the clothes by opening the dryer door, which allows heat to escape. After the operator has determined that the clothes are not yet dried, the dryer must be restarted by setting the timer for an additional time period. Such operation is an inefficient use of the dryer and is wasteful of energy inasmuch as valuable heat has been allowed to escape from the dryer while the dryer was open. Such operations additionally require the constant attention of an operator to determine whether the dryer must be restarted to complete the drying of the load.

With the advent of man-made fabrics, it is often desirable to shut the dryer off before the load has been completely dried. That type operation requires the constant attention of the operator and the frequent opening of the dryer door to inspect the present condition of the load. Thus, such operations are extremely inefficient, require constant attention by an operator to assure the load is not over-dried or under-dried, and results in a large amount of wasted energy.

SUMMARY OF THE PRESENT INVENTION

According to one aspect of the present inventin, there is provided a control system for completely and automatically controlling of the operation of a dryer. A circuit is provided for periodically producing signals representative of the present temperature of a load to be dried. A first control circuit applies heat to the load in response to the signals representative of the present temperature of the load to be dried. A circuit determines a time interval for the load to be dried to reach one predetermined temperature from another predetermined temperature. That time interval is representative of the current condition of the load. A control circuit shuts the dryer off in response to the current condition of the load.

Another aspect of the present invention is a method for automatically controlling the complete operation of a dryer including the steps of periodically producing signals representative of the present temperature of a load to be dired. Heat is applied in response to the signals representative of the present temperature of the load to be dried. A time interval for the load to be dried to reach one predetermined temperature from another predetermined temperature is determined. That time interval is representative of the present condition of the load. The dryer is shut off in response to the current condition of the load.

The present invention is for a dryer control system capable of controlling the operation of a dryer to efficiently apply heat to a load until it reaches a desired, predetermined condition. That condition may be either totally dry or any intermediate condition wherein the load retains some moisture content. The dryer is capable of receiving a wet load and drying that load until it reaches the predetermined desired condition without any inspection by an operator. These and other advantages and benefits of the present invention will become apparent from the description of the preferred embodiment hereinbelow.

DESCRIPTION OF THE PREFERRED EMBODIMENT

I. Brief Structural Description

Figure 1:
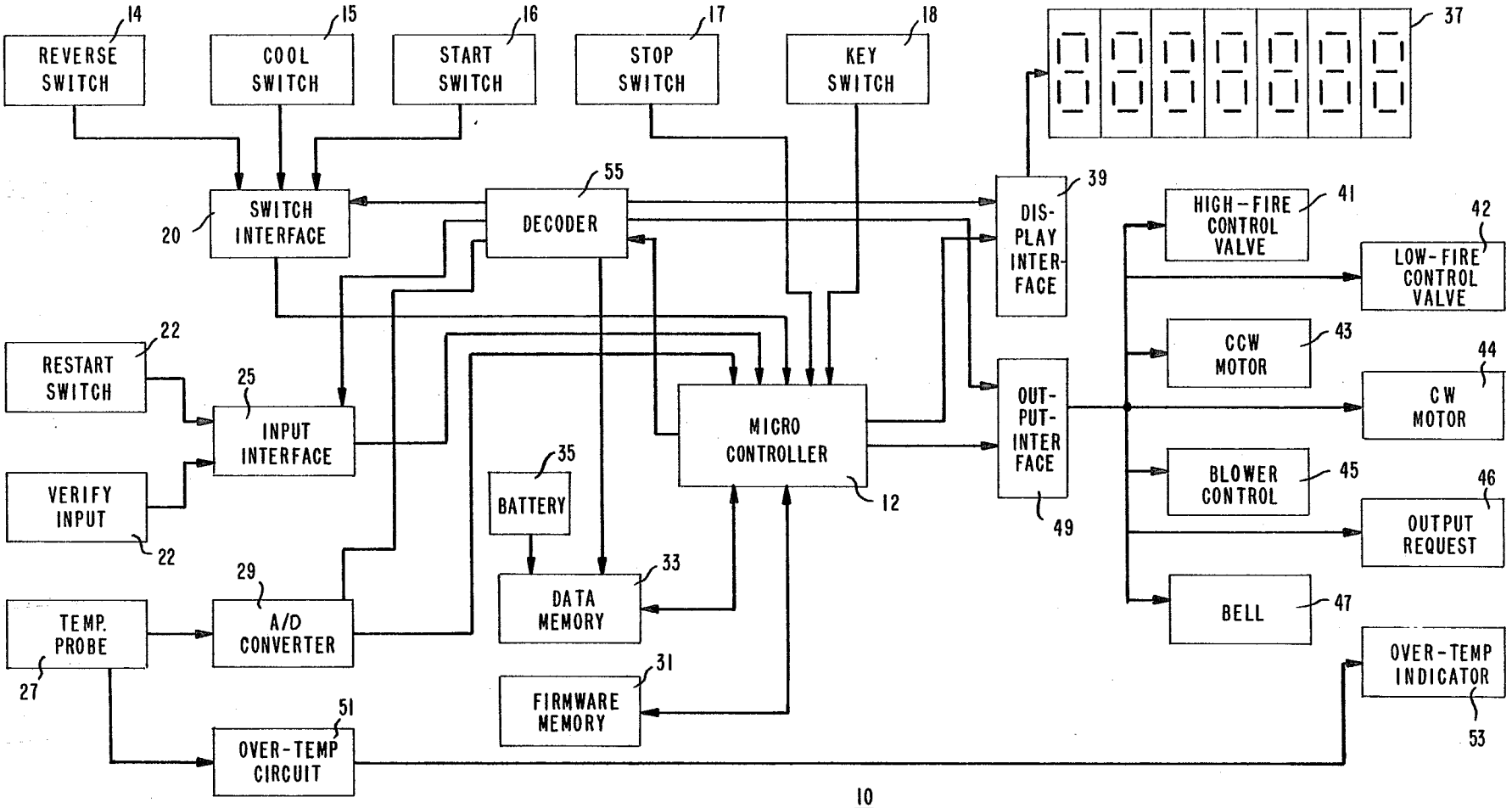
FIG. 1 is a block diagram of an automated dryer control system constructed according to the teachings of the present invention.

FIG. 1 illustrates an automated dryer control system 10 constructed according to the teachings of the present invention. The heart of the dryer control system 10 is a microcontroller 12. The microcontroller 12 receives input information from the user through a reverse switch 14, a cool switch 15, a start switch 16, a stop switch 17, and a key switch 18. The reverse switch 14 is used on commercial reversible-type dryers whenever it is desirable to rotate the load in different directions to prevent the clothes from becoming twisted. The cool switch 15 is used to enable a separate cooling routine to reduce the temperature of the clothes after they have been dried. The start switch 16 is used to initiate operation of the dryer. The reverse switch 14, cool switch 15, and start switch 16 are input to the microcontroller 12 through a switch interface 20.

The stop switch 17 is used for terminating all operations of the dryer regardless of the present condition of the load to be dried. The key switch 18 is used to enable or disable the dryer to prevent unauthorized operation. The stop switch 17 and key switch 18 may also be used to perform other functions, depending upon the programming of the microcontroller 12; and are input directly to the microcontroller 12.

The microcontroller 12 also receives input signals from a restart switch 22 and a verified input 23 through an input interface 25. The restart switch is another user operated input switch which identifies the start of a new load to be dried. The verified input is used on gas dryers to verify that the pilot is lit before opening the gas valves.

The microcontroller 12 also receives an input signal from a temperature probe 27. The temperature probe 27 produces analog signals representative of the present tmeperature of the load. Those signals are input to an analog to digital converter 29 which digitizes the analog signal and outputs the digitized information for receipt by the microcontroller 12. The microcontroller 12 automatically controls the operation of the dryer in response to information received from the various inputs and in accordance with its operational instructions stored in a firmware memory 31. Data input to the microcontroller 12 which must be stored for future reference or intermediate calculations performed by the microcontroller 12 which must be stored for future use are stored in a data memory 33. For added protection the data memory 33 is backed up by a battery 35 which prevents the inadvertent loss of the stored data or intermediate calculations in the event of a power failure.

The microcontroller 12 outputs signals to a display 37 through a display interface 39. The display 37 is visible to the user and conveys operational information to the user according to the programming of the microcontroller 12 stored in the firmware memory 31. The displayed information may include the cycle which the dryer is performing on the load, the time remaining for a given cycle, a message that the load is dry, or any other desirable information.

The microcontroller 12 also outputs signals to a variety of output devices including a high-fire control valve 41, a low-fire control valve 42, a counterclockwise (CCW) motor 43, a clockwise (CW) motor 44, a blower control 45, an output request 46, and a bell 47 through an output interface 49.

The high-fire control valve 41 and low-fire control valve 42 control large and small, respectively gas jets or other heat sources. The counterclockwise motor 43 and clockwise motor 44 control the direction of rotation of a tumbler which carries the load to be dried. The blower control 45 is a large fan which forces air through the tumbler. The output request 46 activates the verify input 23 which insures that the pilot light is lit before opening any of the gas valves. The bell output 47 may be used to indicate when the dryer has been automatically shut off by the automated dryer control circuit 10. An overtemperature circuit 51 is responsive to the temperature probe 27 for determining if the present temperature of the load to be dried has exceeded a predetermined maximum temperature. If the present temperature of the load has exceeded the predetermined maximum temperature, an overtemperature alarm signal is produced which is output to an overtemperature indicator 53.

Completing the description of the automated dryer control circuit 10 shown in FIG. 1, a decoder 55 is responsive to the microcontroller 12 for addressing the switch interface 20, input interface 25, analog to digital converter 29, data memory 33, display interface 39, and output interface 49. Those skilled in the art will recognize that a decoder such as decoder 55 is necessary in any microcontrolled circuit to enable the microcontroller 12 to individually address various components to enable them to output or input data from a data bus or the like.

II. BRIEF FUNCTIONAL DESCRIPTION

Figure 2:
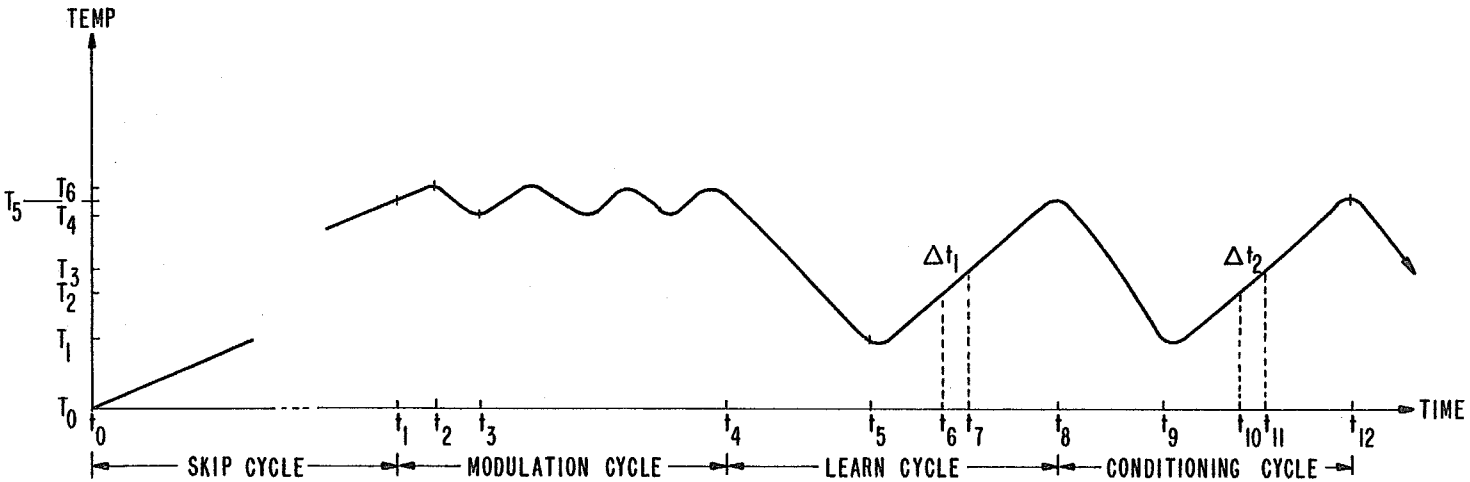
FIG. 2 is a graph of a temperature versus time curve of a dryer being operated by the automated control system of FIG. 1.

Turning now to FIG. 2, at time $t_o$ a load at temperature $T_o$ is placed in the tumbler of an automatic, reversing-type, commercial gas dryer. When the burner of the dryer is ignited applying heat to the newly inserted load, it will take a certain amount of time for the temperature of the load to rise to temperature $T_5$. That time is directly related to the amount of moisture in the load. When the load is heated in the dryer for the first time, the time interval from time $t_o$ to time $t_1$ required for the load to increase from temperature $T_o$ to temperature $T_5$ can be very erratic and vary from load to load depending on the type of material, the surface rejection of heat, the moisture content, and the packing of the material. Therefore, this initial increase in temperature from to time $t_o$ to time $t_1$ is ignored by the automated control system 10 and is relied on for purposes of distributing the load mass and preheating the load. This initial rise, or cycle, is referred to as the "skip cycle" because the microcontroller 12 takes no action.

When a wet load is placed in the dryer it is anticipated that when the burner is shut off the load temperature will drop quickly and when the burner is turned on the load temperature will rise slowly. It is also known that the longer the temperature of the load is at temperature $T_5$ the faster the load is dried and the more efficiently the dryer operates. Thus, it is often desirable to provide preheating to the load in addition to the preheating accomplished during the "skip cycle". This additional preheating is provided by a preheating modulation cycle.

The preheating modulation cycle is shown in FIG. 2 from time $t_1$ to time $t_4$. At time $t_1$ the temperature of the load has reached temperature $t_5$. The burner, however, is not shut off until the temperature of the load reaches temperature $T_6$ at time $t_2$. When the burner is shut off the temperature falls to temperature $T_4$ at time $t_3$. At this temperature the burner is refired, thus causing the temperature of the load to increase. By repeating this operation the temperature of the load is modulated about temperature $T_5$. Keeping the temperature of the load at that elevated temperature preheats the load in a very efficient manner.

The duration of the preheating modulation cycle depends upon the programming of the microcontroller 12 and may be set to any convenient value.

At time $t_4$ in FIG. 2 the preheating modulation cycle has come to an end and the temperature is allowed to fall below temperature $T_4$ until the temperature of the load reaches temperature T, which occurs at time $t_5$. At time $t_5$ the burners are turned on and heat is applied to the load. Even though heat is being applied to the load, the present temperature of the load may fall slightly below temperature $T_1$ due to thermal inertia or hysteresis in the gas valve.

As the temperature begins to increase, the microcontroller 12 determines the time interval ($\Delta t_1$) for the temperature of the load to rise from temperature $T_2$ to temperature $T_3$. This timer interval is the time between time $t_6$ and time $t_7$. The temperature of the load continues to increase until it reaches temperature $t_5$ at time $t_8$.

The time interval from time $t_4$ to time $t_8$ is called the "learn cycle" because the microprocessor "learns" the time interval necessary for the temperature of the load to reach temperature $T_3$ from temperature $T_2$. This time interval is stored as a reference time interval to which all subsequent time intervals will be compared and is used by the microcontroller 12 to represent a value of 100% relative humidity.

At time $t_9$ the temperature of the load has fallen to temperature $T_1$. The burner is turned on and the temperature once again increases to temperature $T_5$ at time $t_{12}$. During the increase in temperature the microcontroller 12 determines the time interval for the temperature to rise from temperature $T_2$ to temperature $T_3$. This time interval ($\Delta t_2$) is shown in FIG. 2 between time$t_{10}$ and $t_{11}$ and represents the present condition of the load.

The microcontroller 12 continues cycling the temperature of the load through additional conditioning cycles. As the load becomes drier, the time interval for the temperature of the load to increase from temperature $T_2$ to temperature $T_3$ decreases. The automated dryer control system 10 may be set to recognize any predetermined load contion and will shut the dryer off when that predetermined load condition has been met.

For example, with no-iron clothing it is desirable to shut the dryer off before the clothes have been completely dried. This can be accomplished by programming the microcontroller 12 to recognize a predetermined relationship between the time interval measured during a conditioning cycle and the time interval measured during the learning cycle. Thus, it may be desirable to shut the dryer off when the moisture remaining in the load is 80% of the starting condition of the load. That can be accomplished by programming the microcontroller 12 to shut the dryer off when the time interval measured during a conditioning cycle is 80% of the time interval measured during the learning cycle. Any desired load condition can thus be achieved by suitable programming of the microcontroller 12.

It may be desirable to have the clothes completely dried rather than conditioned. When all the moisture is removed from the load the time interval from one conditioning cycle to the next will remain essentially constant because, with the moisture driven off, all that is left is a constant mass. With a constant mass, a constant amount of energy from the burner should be sufficient to raise the temperature of the load from temperature $T_2$ to temperature $T_3$. Unfortunately, variables such as air intake, exhaust head pressure variations, burner variations, leaks in doors or duct work, and tumbler variations cause minor variations in time intervals from conditioning cycle to conditioning cycle even when the load is dry. Those minor variations can be overcome by appropriately programming the microcontroller 12 to recognize when the time intervals measured during successive conditioning cycles are within a repeat parameter of each other. For example, the microcontroller 12 will recognize successive time intervals of fifteen seconds and fifteen and one-quarter seconds as being equal if the repeat parameter is equal to one-half second.

As mentioned above, the longer the dryer operates at or near temperature $T_5$, the faster and more efficiently a load will be dried. That is the reason why the burner is left on after temperature $T_3$ is reached, to allow the temperature to "overburn" to a higher, more efficient operating temperature, such as temperature $T_5$. This is known as temperature overburn.

Another type of overburn is known as real time overburn. This type of overburn (not shown in FIG. 2) is a modulation of the temperature about temperature $T_5$, between temperature $T_4$ and temperature $T_6$, for a predetermined period of time. This is essentially the same process as the modulation cycle shown in FIG. 2 from time $t_1$ to time $t_4$, but it occurs after the learn cycle and between conditioning cycles.

One advantage of overburn is that it has a self-compensating effect. When a new damp load is inserted in the dryer, the time between scans will be long because the temperature rises slowly on a wet load. As the load dries, the time between scans will become shorter, and more scans will be taken. Thus, a decrease in the number of scans in the early phases of drying due to time spent in overburn will be compensated for later because the load will be dried quicker, and more scans will be taken sooner on the dry load.

Another advantage of overburn is that when a new damp load is inserted in the dryer, the dryer may not be capable of significantly reducing the moisture content from one scan to the next. Thus, successive scans may be within the repeat parameter, and the dryer mistakenly identifies the load as being dried. However, with overburn sufficient moisture will be drive off such that successive scans will not be within the repeat parameter, and there will be no false identification of a dry load.

In the foregoing description exemplary temperatures are $T_1$=173° F. (78.33° C.); $T_2$=175° F. (79.44° C.); $T_3$=190° F. (87.78° C.); $T_4$=205° F. (96.11° C.); $T_5$=210° F. (98.89° C.); $T_6$215° F. (101.67° C.). Temperatures $T_2$ and $T_3$ are chosen such that the temperature rise is essentially linear with respect to time. This allows the microcontroller 12 to operate on a linear portion of the temperature versus time curve for the dryer thus insuring acceptable results.

From the foregoing brief description of the operation of the automated dryer control system 10 shown in FIG. 1 it is apparent that the present invention represents a substantial improvement over prior art dryers. The dryer control system 10 may be set to continually monitor the present condition of a load and shut the dryer off whenever the load reaches a predetermined desired condition. That desired condition may be a condition wherein the load retains some percentage of moisture or a condition wherein the load is totally dried. In either case, the dryer efficiently dries the load to the predetermined desired condition without any supervision by an operator. Also, because the automated dryer control system 10 "learns" a new reference time interval for each load, it automatically compensates for half-loads, light fabrics, or the like.

III. Detailed Structural Description

Figure 3A:
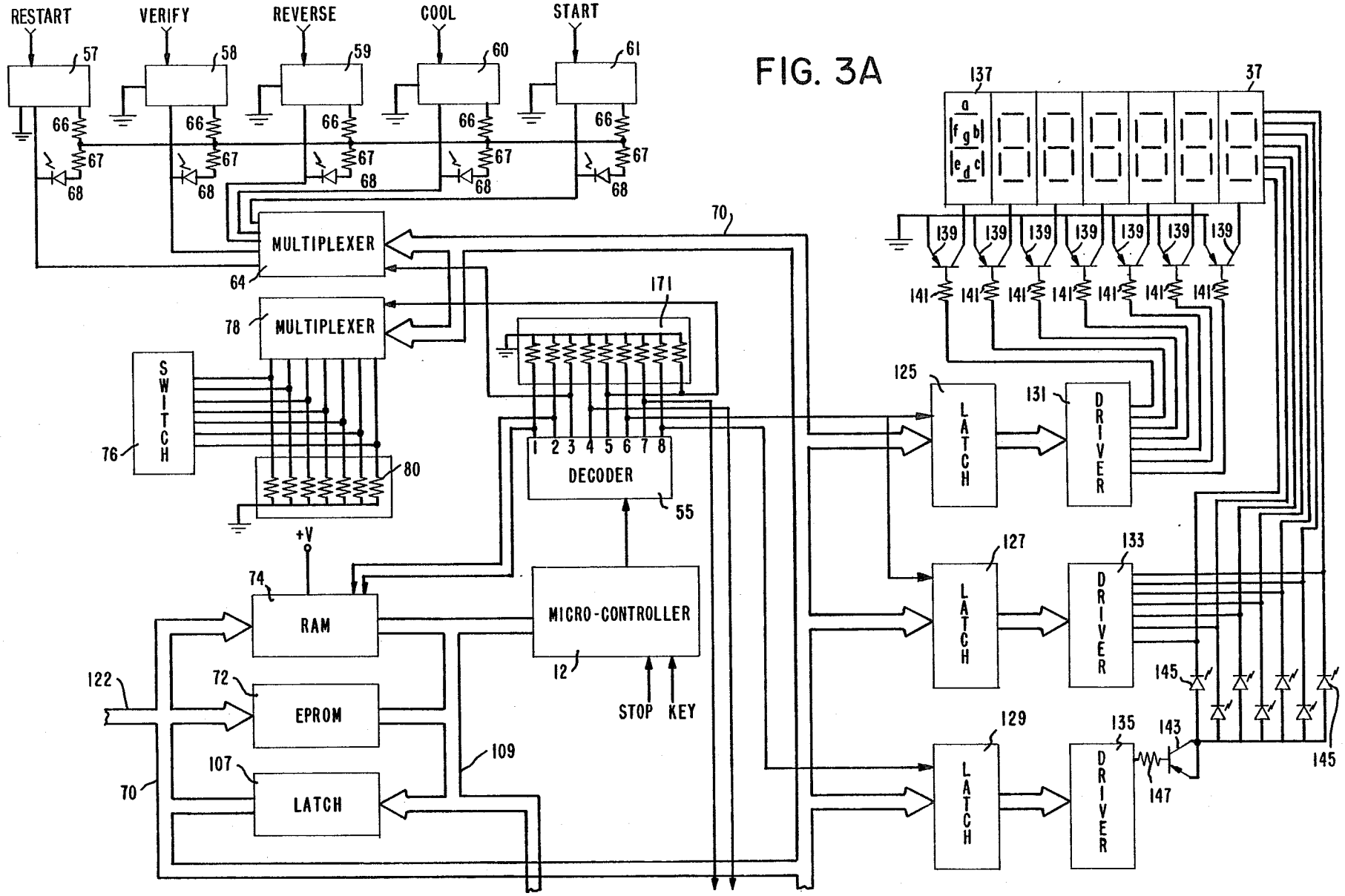
FIGS. 3A and 3B are electrical schematics of the automated dryer control system shown in FIG. 1.
Figure 3B:
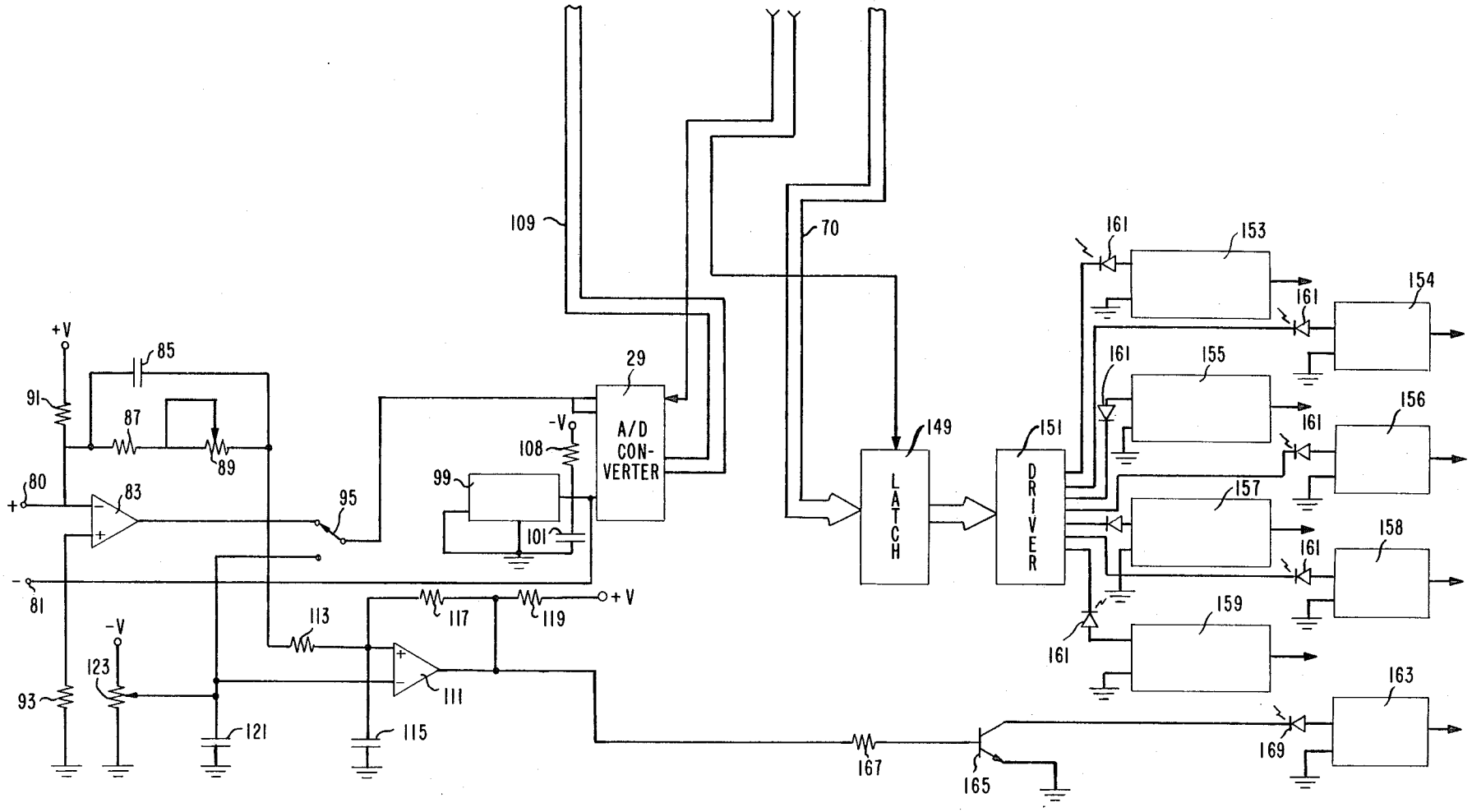

FIGS. 3A and 3B are electrical schematics illustrating the automated dryer control system 10 shown in block diagram form in FIG. 1. In FIGS. 3A and 3B similar components have similar reference numerals.

Input signals produced by the restart switch 22, verify input 23, reverse switch 14, cool switch 15, and start switch 16, shown in FIG. 1, are input to optical isolators 57 through 61, respectively. The optical isolators 57–61 perform the function of the input interface 25 and switch interface 20 illustrated in FIG. 1.

Each optical isolator 57–61 has one output terminal connected to ground, and a second output terminal connected to a multiplexer 64. Each optical isolator 57–61 further has a third terminal connected to its second terminal through a series combination of a first resistor 66, a second resistor 67, and a light emitting diode 68. The junction between the first resistor 66 and the second resistor 67 of the optical isolator 57 is connected to the junction between the first resistor 66 and the second resistor 67 of all of the other optical isolators 57–61. The light emitting diodes 68 are responsive to the operation of their respective optical isolator 57–61. The optical isolators 57–61 provide electrical isolation of the microcontroller system shown in FIGS. 3A and 3B from the various input devices.

The input signals available at the output terminals of the optical isolators 57–61 are placed on a first data bus 70 by a multiplexer 64 in response to control signals from the microcontroller 12. The control signals are input to the multiplexer 64 via a third output terminal of the decoder 55. The first data bus 70 allows the multiplexer 64 to communicate with an erasable programmable read only memory 72 (EPROM) and a random access memory 74 (RAM). The EPROM 72 performs the function of the firmware memory 31 shown in FIG. 1 while the RAM 74 performs the function of the data memory 33 shown in FIG. 1. The battery 35 shown in FIG. 1 is represented in FIG. 3A as a source of positive voltage.

A switch 76 produces control signals which determine which gas jets, the high-fire or the low-fire, will be operated in response to the present temperature of the load. The switch has seven output terminals which are connected to a multiplexer 78. The multiplexer 78 detemines which of the various output signals produced by the switch 76 will be placed on the first data bus 70 in response to control signals from the microcontroller 12 input via a fifth output terminal of the decoder 55. Each of the seven output terminals of the switch 76 is also connected to ground through a resistor 80.

The temperature probe 27 shown in FIG. 1 is connected across a positive input terminal 80 and a negative input terminal 81. The positive input terminal 80 is connected to an inverting input terminal of an operational amplifier 83. An output terminal of the operational amplifier 83 is connected to the inverting input terminal through the combination of a capacitor 85 connected in parallel with the series combination of a resistor 87 and a variable resistor 89. The inverting input terminal of the operation alamplifier 83 is further connected to a positive source of voltage through a resistor 91. A non-inverting input terminal of the operational amplifier 83 is connected to ground through a resistor 93.

The temperature probe shown in FIG. 1 may be located in any convenient location such as the dryer's exhaust stack. The signal produced by the temperature probe 27 is representative of the present temperature of the load. Clearly, the further and temperature probe is from the dryer the lower the sensed temperatures will be. Thus, the exemplary temperatures discussed above in conjunction with FIG. 2 would be accordingly adjusted.

When a switch 95 is in a first position as shown in FIG. 3B, the signal representative of the present temperature of the load is input to two input terminals of the analog to digital converter 29. A voltage reference terminal of the analog to digital converter 29 is connected to the negative input terminal 81, to a voltage regulator 99, to ground through a capacitor 101, and to a negative voltage source through a resistor 103. The voltage regulator 99 has two additional terminals which are also grounded. That circuitry provides a very stable reference voltage for the analog to digital converter 29.

The analog to digital convertor 29 digitizes the signal representative of the present temperature of the load. In response to a control signal from the microcontroller 12, input via terminal 7 of the decoder 55, the analog to digital converter 29 inputs the digitized information to a latch 107 through a second data bus 109. The second data bus additionally connects the analog to digital convertor 29 and the latch 107 to the EPROM 72, RAM 74, and the microcontroller 12.

The output terminal of the operational amplifier 83 is connected to a non-inverting input terminal of an operational amplifier 111 through a resistor 113. The non-inverting input terminal of the operational amplifier 111 is additionally connected to ground through a capacitor 115 and to a positive voltage source through a series combination of a resistor 117 and a resistor 119. The junction between the resistors 117 and 119 is connected to an output terminal of the operational amplifier 111. An inverting input terminal of the operational amplifier 111 is connected to ground through a capacitor 121 and to the wiper of a variable resistor 123 which is connected between a positive voltage source and ground. The operational amplifier 111 and related components form the function of the over-temperature circuit 51 illustrated in FIG. 1.

The inverting input terminal of the operational amplifier 111 is additionally connected to the switch 95. When the switch is in the opposite position from that shown in FIG. 3B the overtemperature circuit 51 is connected to the temperature probe 27. The operational amplifier 111 acts as a comparator comparing the signal representative of the present temperature of the load to a reference voltage determined by the position of the wiper of the variable resistor 123. The reference voltage represents a predetermined maximum temperature. Whenever the present temperature of the load exceeds the predetermined maximum temperature the overtemperature alarm signal is produced by the operational amplifier 111 and is available at its output terminal.

Inputs from the stop switch 17 and key switch 18 shown in FIG. 1 are input directly to the microcontroller 12 as shown in FIG. 3A.

The first data bus 70 may additionally be accessed at point 122 by an external device such as a keyboard, not shown. Such external accessing may be used to change the programming stored in the EPROM 72.

The microcontroller 12 places output data for the display 37 on the first data bus 70. The first data bus 70 is connected to a first latch 125, a second latch 127, and a third latch 129. A driver 131 is responsive to the first latch 125, a driver 133 is responsive to the second latch 127, and a driver 135 is responsive to the third latch 129. The microcontroller 12 controls the operation of the latches 125, and 127 by a control signal input via a sixth output terminal of the decoder 55 and controls the latch 129 by a control signal input via an eighth output terminal of the decoder 55 to coordinate their receipt of information from the first data bus 70.

The display 37 is a seven segment display with each segment capable of displaying an alpha-numeric character. The first segment 137 of the seven segment display 37 is connected to a collector of a transistor 139. The emitter of the transistor 139 is connected to ground and the base of the transistor 139 is connected to an output terminal of the driver 131 through a resistor 141. Each of the remaining segments of the display 37 is similarly connected to an output terminal of the driver 131 through a transistor 139 and a resistor 141. The latches 125, 127, and 129, the drivers 131, 133, and 135 and the transistors 139 perform the function of the display interface 39 shown in FIG. 1.

The display 37 has seven input terminals which are connected to seven output terminals of the driver 133. Each of the input terminals of the display 37 is connected to the collector of a transistor 143 through a light emitting diode 145. The emitter of the transistor 143 is also connected to the collector of the transistor 143. The base of the transistor 143 is connected to the driver 135 through a resistor 147. The seven output terminals of the driver 133 determine which of the seven elements (a, b, c, d, e, f, and/or g) is to be lit thus forming the desired alpha-numeric character. Each of the outputs of the driver 131 determines which segment of the seven segment display is to respond to the signals output by the driver 133. By sequentially lighting each segment of the seven segment display at a speed greater than the retention time of the human eye, each of the segments of the display appear to be lit simultaneously thus conveying the information to the user in a standard and well-known manner.

The microcontroller 12 also places signals for controlling the operation of the dryer for the latch 149 on the first data bus 70. The microcontroller 12 controls the latch 149 by signals input via a fourth terminal of the decoder 55 to coordinate receipt of the signals for controlling the operation of the dryer from the first data bus 70. A driver 151 is responsive to the latch 149. The driver 151 has seven output terminals, each one controlling the operation of a solid state relay. A first solid state relay 153 controls the high-fire control valve 41, a second solid state relay 154 controls the low-fire control valve 42, a third solid state relay 155 controls the counterclockwise motor 43, a fourth solid state relay 156 controls the clockwise motor 44, a fifth solid state relay 157 controls the blower control 45, a sixth solid state relay 158 controls the output request 46, and a seventh solid state relay 159 controls the bell 47. Each of the solid state relays 153–159, has a first output terminal connected to ground and a second output terminal connected to the driver 151 through a light emitting diode 161.

The overtemperature alarm signal available at the output terminal of the operational amplifier 111 is input to a base of a driving transistor 165 through a resistor 167. A collector of the transistor 165 is connected to an input terminal of a solid state relay 163 through a light emitting diode 169. An emitter of the transistor 165 and a second input terminal of the solid state relay 163 are both connected to ground. The overtemperature alarm signal controls the operation of the solid state relay 163 which in turn controls the operation of the overtemperature indicator 53.

As discussed above, the decoder 55 shown in FIG. 3A is responsive to the microcontroller 12 to produce a plurality of control signals for enabling the various multiplexers, latches, and the RAM 74 used in the circuit. The microcontroller produces output signals representative of the desired component to be enabled and the decoder 55 produces an appropriate signal which is input to the desired component in a standard and well known manner. The decoder has eight output terminals which are each connected to ground through a resistor 171.

The first and second output terminals of the decoder 55 are used to output signals which control the RAM 74. The third output terminal of the decoder 55 is used to output signals to control the multiplexer 64; the fourth output terminal outputs signals to control the latch 149; the fifth output terminal is connected to ground through two parallel connected resistors 171 and outputs signals to control the multiplexer 78; the sixth output terminal outputs signals to control the latches 125 and 127; the seventh output terminal outputs signals to control the analog to digital convertor 29; and the eighth output terminal outputs signals to control the latch 129.

The following table illustrates commercially available components used to construct the automated dryer control system shown in FIGS. 3A and 3B.

TABLE NO. 1

| COMPONENT | NUMBER | MANUFACTURER |
|---|---|---|
| Microcontroller 12 | 8035 | Intel |
| A/D Converter 29 | 7574 | Analog Devices |
| Decoder 55 | 74LS156 | Motorola |
| Optical Isolators 57–61 | 3700 | Hewlett-Packard |
| Multiplexer 64, 78 | 4512 | Motorola |
| EPROM 72 | 2732 | Intel |
| RAM 74 | 6116 | Hitachi |
| Switch 76 | 206–7 | CTS |
| Voltage Regulator 99 | 581 | Analog Devices |
| Latch 107 | 4508 | Motorola |
| Latch 125, 127, 129, 149 | 4099 | Motorola |
| Driver 131, 133, 135, 151 | 2003 | Motorola |
| Solid State Relays (110 Volt) 153–159, 163 | MP120D3 | Opto 22 |
| Operational Amp 83 | 741 | Texas Instruments |
| Operational Amp 111 | LM311 | RCA |
| Temp. Probe | AC2626J6 | Analog Devices |

Those skilled in the art will recognize that other components produced by other manufacturers may be substituted for the components shown in Table No. 1. Those skilled in the art will also recognize that the electrical schematic shown in FIGS. 3A and 3B is somewhat simplified in that additional pin connections for the various components, filtering capacitors, power supplies, and the like have been omitted for purposes of explanation.

IV. Detailed Functional Description

Figure 4:
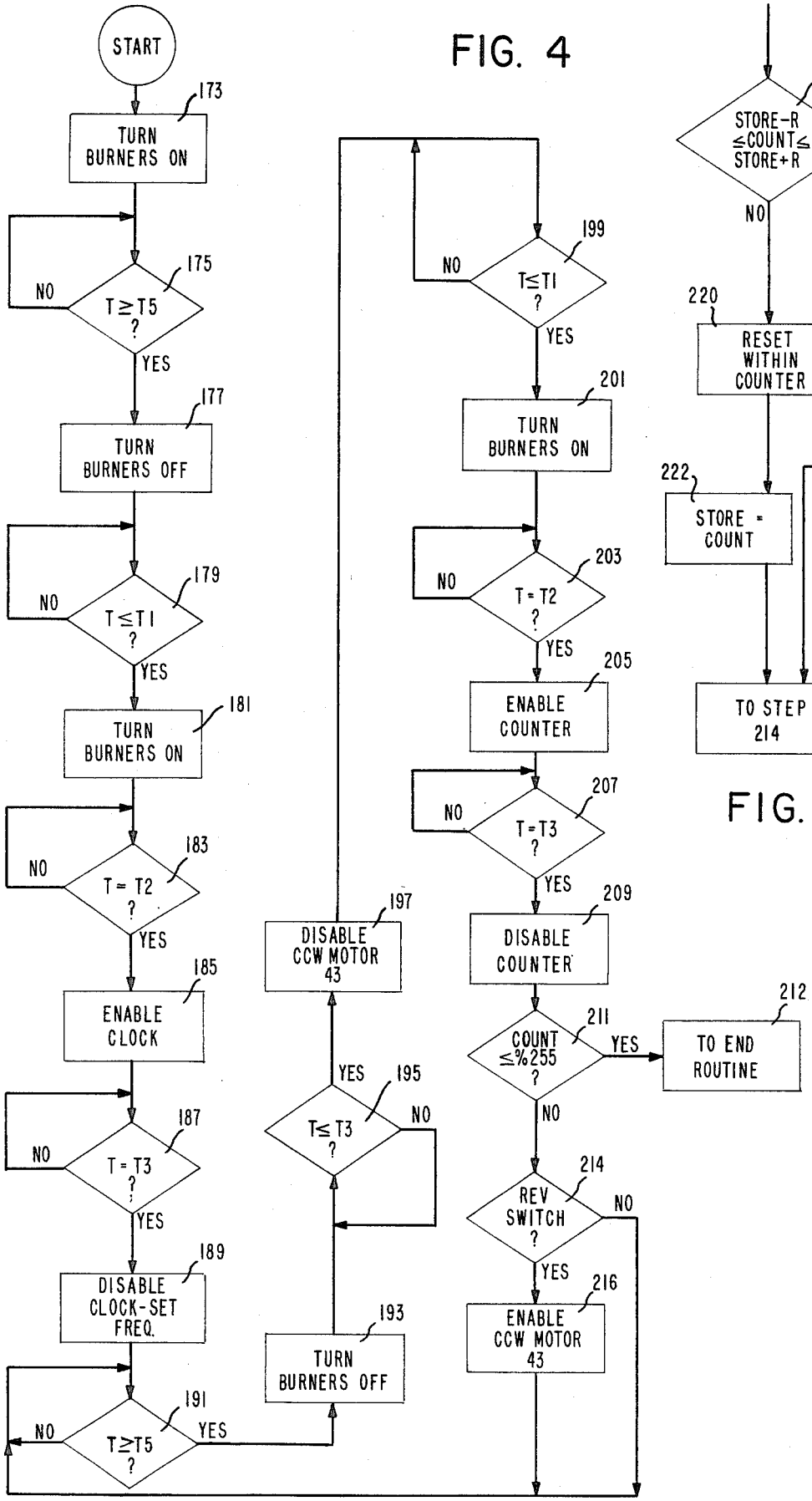
FIG. 4 is a flow chart illustrating the steps of a conditioning cycle performed by the automated dryer control system shown in FIG. 1.

FIG. 4 is a flow chart illustrating the steps of a conditioning cycle performed by the automated dryer control system illustrated in FIG. 1. The conditioning cycle flow chart shown in FIG. 4 is performed whenever the dryer is to be shut off before the clothes are completely dried thus leaving the clothes with a predetermined amount of moisture.

The flow chart begins at step 173 wherein the burners are turned on. This would correspond to time $t_0$ in FIG. 2. The microcontroller 12 remains at decision step 175 until the present temperature of the load is greater than or equal to temperature $T_5$. This occurs at time $t_1$ as shown in FIG. 2. When the present temperature of the load equals temperature $T_5$ the burners are turned off in step 177. Steps 173, 175, and 177 represent the skip cycle shown in FIG. 2. P After the burners have been turned off at step 177 the microcontroller 12 remains at decision step 179 until the present temperature of the load has fallen to a temperature less than or equal to temperature $T_1$. When this occurs the burners are refired at step 181 causing the temperature of the load to increase.

The microcontroller 12 remains at decision step 183 until the present temperature of the load equals temperature $T_2$. This occurs at time $t_6$ shown in FIG. 2. When the present temperature of the load equals temperature $T_2$ the microcontroller 12 begins to measure the time interval required for the present temperature of the load to reach temperature $T_3$ by enabling a clock at step 185. When the temperature of the load reaches temperature $T_3$ as indicated by decision step 187 the microcontroller 12 disables the clock at step 189.

At step 189, after the clock has been disabled the microcontroller 12 adjusts the frequency of a source of variable frequency clock pulses such that two hundred and fifty five clock pulses are produced during the time interval $\Delta t_1$ just measured by the microcontroller. For example, if the time interval $\Delta t_1$ measured during the learn cycle is equal to thirty seconds, the microcontroller 12 adjusts the frequency of the clock pulses such that 7.15 clock pulses are produced each second. Thus, two hundred fifty-five clock pulses would be produced in a thirty-second period. It is important to remember that regardless of the length of the time interval measured during the learn cycle the microcontroller 12 will always adjust the frequency of the clock pulses such that two hundred fifty-five clock pulses are produced during that time interval. This is an important feature of the present invention because subsequent time intervals for the present temperature of the load to go from temperature $T_2$ to temperature $T_3$ will be measured in terms of these variable frequency clock pulses and not real time.

After the microcontroller 12 sets the frequency of the clock pulses at step 189 the microcontroller 12 remains at decision step 191 until the present temperature of the load is greater than or equal to temperature $T_5$. When the present temperature of the load is greater than or equal to temperature $T_5$ the burners are turned off at step 193. The steps 181, 183, 185, 187, 189, 191, and 193 perform the learn cycle shown in FIG. 2.

With the burners turned off the present temperature of the load begins to fall and the microcontroller 12 remains at decision step 195 until the temperature has fallen to temperature $T_3$. When that condition is met, the microcontroller 12 disables the counterclockwise motor 43 at step 197 and enables the clockwise motor 44. On the initial performance of this program the counterclockwise motor 43 will not have been enabled. However, on subsequent performances of this program the counterclockwise motor may have been enabled. Thus, at step 197, it is necessary to disable the counterclockwise motor 43 and enable the clockwise motor 44. This is an important step in the program because the determination of the time interval for the temperature of the load to reach temperature $T_3$ from temperature $T_2$ must be made for the learn cycle and each conditioning cycle while the load is being displaced in the same direction, i.e., either by the clockwise motor 44 or the counterclockwise motor 43.

After the counterclockwise motor 43 has been disabled in step 197 the microcontroller 12 remains at decision step 199 until the present temperature of the load falls below or is equal to temperature $T_1$. At that time the burners are turned on at step 201 and the temperature begins to increase.

At decision step 203 the microcontroller 12 determines when the present temperature of the load equals temperature $T_2$ and when it does, a counter is enabled at step 205. The counter totalizes the variable frequency clock pulses (the frequency of those clock pulses having been determined at step 189) until the present temperature of the load reaches temperature $T_3$ as indicated by decision step 207. At that time the counter is disabled at step 209. The steps 203, 205, 207, and 209 allow the microcontroller 12 to determine the time interval for the present temperature of the load to increase from temperature $T_2$ to temperature $T_3$. This time interval is measured in terms of the totalized variable frequency clock pulses and is representative of the current condition of the load.

In decision step 211 the microcontroller 12 compares the totalized count of variable frequency clock pulses to some predetermined percentage of two hundred fifty-five. This step in effect is the comparison of the present condition of the load to a reference condition. Because two hundred fifty-five represent 100% humidity, the user may determine the desired condition of the load by determining a predetermined fractional value of two hundred fifty-five for use as the reference.

For example, the microcontroller 12 may be programmed to recognize one of four conditions. In condition one the moisture content in the load is 90% of the reference value. That would be achieved by comparing the totalized count representative of the present condition of the load to a reference count of two hundred thirty (90% of 255). Similarly, the microcontroller 12 may be programmed to recognize load conditions having moisture contents of 80%, 70% and 60% by comparing the present count to reference values of two hundred four, one hundred seventy-nine and one hundred fifty-three, respectively. Thus, the user may select a predetermined desired condition for the load by choosing an appropriate fractional value of two hundred fifty-five.

From decision step 211, if the present count is less than or equal to the selected fractional value of two hundred fifty-five thus indicating the present condition of the load is equal to the desired predetermined condition, the microcontroller 12 proceeds to an end routine represented by step 212. The end routine will be discussed in detail in conjunction with FIG. 6 hereinbelow.

In the event the present count is greater than the predetermined desired fractional value of two hundred fifty-five the microcontroller 12 proceeds to decision step 214. At step 214 the microcontroller 12 determines whether the user has operated the reverse switch 14. If the reverse switch 14 has not been operated the microcontroller 12 proceeds to step 191 and that portion of the program is repeated until the present condition of the load equals the predetermined desired condition. If the reverse switch 14 has been operated, the counterclockwise motor 43 is enabled at step 216.

By enabling the counterclockwise motor 43 the load is rotated in a direction opposite from the direction of rotation by the clockwise motor 44. By rotating the load in alternating directions twisting and knotting of the clothes in the dryer is avoided. After the counterclockwise motor 43 has been enabled at step 216 the microcontroller 12 returns to decision step 191.

This concludes the discussion of the flow chart shown in FIG. 4 which is performed in order to dry clothes to a predetermined desired condition. However, it is often desired to dry clothes completely. The drying cycle performed by the automated dryer control system 10 shown in FIG. 1 will now be discussed in conjunction with FIG. 5.

Figure 5:
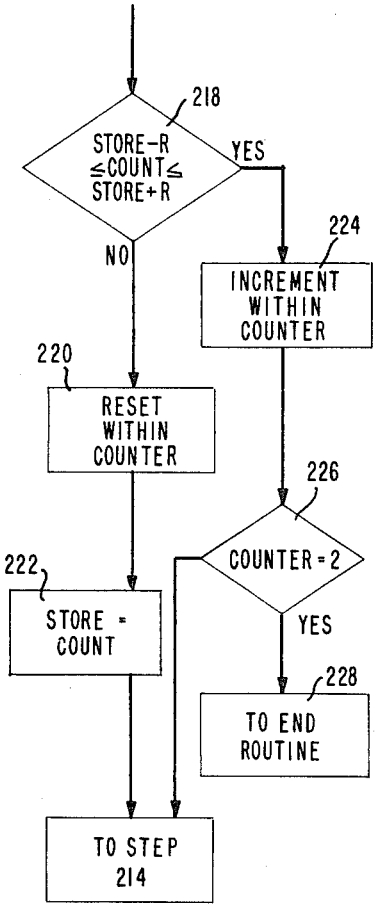
FIG. 5 is a flow chart illustrating the steps of a drying cycle performed by the automated dryer control system shown in FIG. 1.

The overall operation of the drying cycle is identical to the operation of the conditioning cycle described in conjunction with FIG. 4 except that instead of the decision step 211 shown in FIG. 4 the microcontroller 12 performs the six steps illustrated in FIG. 5. Thus, the operation of burners, the adjustment of the frequency of the variable frequency clock pulses, the enablement of the clockwise motor 44 and counterclockwise motor 43, and enablement of the counter for totalizing the variable frequency clock pulses during the measured time interval are all the same. However, instead of the decision step 211 wherein the present count is compared to a reference count, the microcontroller 12 performs decision step 218. At decision step 218 the value of the present count is compared to the previous count, which has been stored, to determine if the present count is greater than the previous count minus a repeat parameter R and less than the previous count plus the repeat parameter R. If the present count is not within that range as required by decision step 218 the microcontroller 12 resets a within counter 220, places the present count into memory at step 222, and proceeds to decision step 214 shown in FIG. 4.

However, if at decision step 218 the present count is within the required range of the previous count the microcontroller 12 increments the within counter at step 224. The microcontroller 12 interrogates the within counter at decision step 226 to determine if it contains a value of two. (Clearly, the microcontroller 12 can be programmed to recognize any value.) If not, the microcontroller proceeds to step 214. If the within counter contains a value of two the microcontroller proceeds to the end routine as indicated by step 228. The end routine is the same end routine mentioned at step 212 in FIG. 4 and will be discussed hereinbelow in conjunction with FIG. 6.

The function of the six steps which make up the important portion of the drying cycle is to determine if the present count has reached a stable value. As the load begins to dry the present count will continually decrease from a value of two hundred fifty-five. As the load continues to dry the present count will become smaller and there will be less difference between successive counts. When the load has reached a point at which it is dry, theoretically the present count would be exactly the same as the previous count because the thermal mass of the load is constant. However, because of such factors as air intake, exhaust head pressure variations, burner variations, leaks in doors or duct work, and variations in tumbler revolutions the count will probably never reach a value which is exactly repeatable between successive scans. Thus, it is desirable to choose a repeat parameter R which can be any value between, for example, one and thirty counts. Each count equals 0.4%. Thus, if a scan results in a count of fifty-five, and the repeat parameter is five counts (±2%), the next scan count will be compared at step 218 to determine if it is greater than fifty and less than sixty. If not, the within counter is reset.

However, if the present count is within the range of fifty to sixty the microcontroller 12 increments the within counter at step 224. It is possible however for a load not to be dried and yet have a present count within the range of the previous count set by the repeat parameter. Thus, the microcontroller 12 is programed to insure that at least two successive counts are within the repeat parameter. Thus, even though in our example the present count was within the range of fifty to sixty, if the within counter does not equal two the microcontroller 12 will require an additional count as indicated by the negative determination at decision step 226. If the successive count should again produce a value which is within the repeat range of fifty to sixty, the within counter will be incremented and will now have a value of two, and the microcontroller 12 will proceed to the end routine at step 228. In this manner, the automated dryer control system 10 shown in FIG. 1 can continually monitor the condition of the load and shut the dryer off when the counts indicate that the load is dried. Thus, no energy is wasted by having the dryer continue to run after the load has been dried. Also, there is no concern about having the dryer prematurely shut off before the load has been dried.

Figure 6:
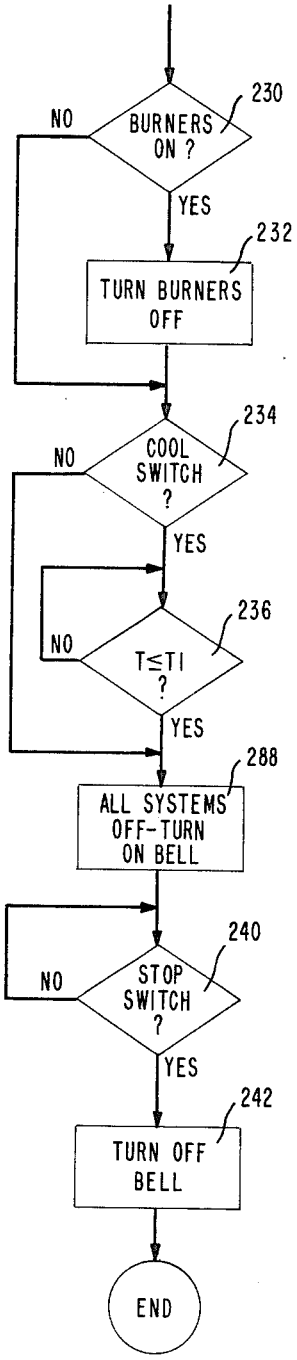
FIG. 6 is a flow chart illustrating the steps of an end routine performed by the automated dryer control system shown in FIG. 1.

FIG. 6 illustrating a flow chart of the end routine referred to in conjunction with the conditioning and drying cycles discussed above will now be explained. At decision step 230 the microcontroller 12 determines if the burners are on. If they are on, the burners are turned off at step 232 because the load has reached the desired predetermined condition or is dry. If the burners are not on the microcontroller 12 proceeds directly to decision step 234 wherein the microcontroller 12 determines if the cool switch has been operated by the user.

If the cool switch has been operated the microcontroller 12 proceeds to decision step 236 wherein the present temperature of the load is compared to temperature $T_1'$. Temperature $T_1'$ (not shown in FIG. 2) is some value below temperature $T_1$ such as 150° (65.56° C.). During this time, both the clockwise motor 44 and the blower are operating such that the present temperature of the load will begin to drop. The microcontroller remains at decision step 236 until the present temperature of the load falls below temperature $T_1'$. At that time, the microcontroller 12 turns off all systems and turns on an alarm bell to signal to the user that the dryer has been shut off at step 238. If the cool switch had not been operated by the user the microcontroller 12 would proceed directly to step 238. In order to assure that the user responds to the bell, decision step 240 requires the user to operate the stop switch in response to the bell. The bell will continue to ring until the stop switch has been operated. Once the stop switch has been operated the microcontroller 12 turns the bell off at step 242.

Figure 7:
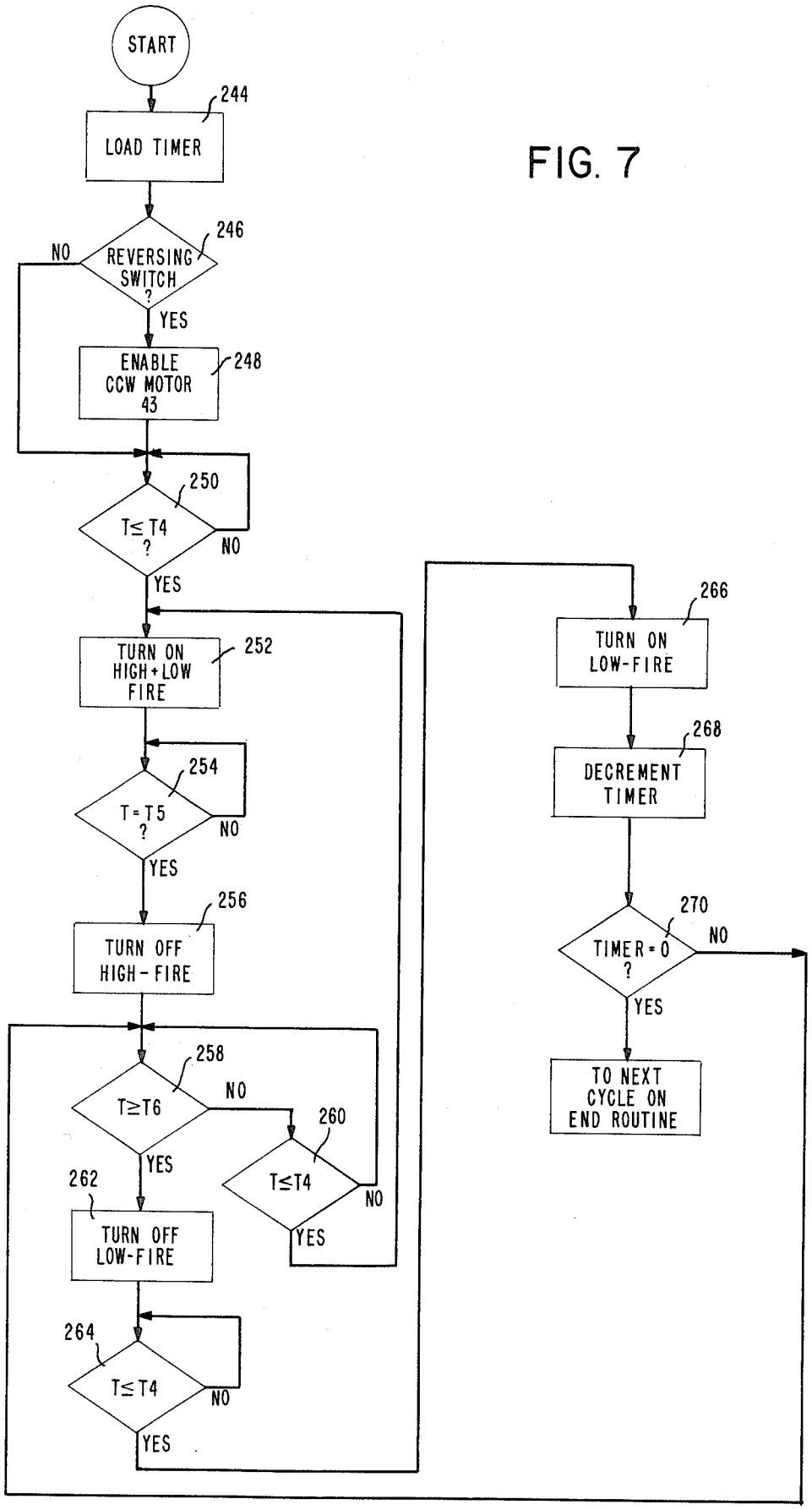
FIG. 7 is a flow chart illustrating the steps of a preheating modulation cycle performed by the automated dryer control system shown in FIG. 1.

It may be desirable with some loads to additionally preheat the load by use of a modulation cycle as discussed above in conjunction with FIG. 2. A flow chart illustrating the steps performed by the microcontroller 12 in performing a preheating modulation cycle are illustrated in FIG. 7. In FIG. 7, a timer is loaded at step 244 with a value representative of the duration of the modulation cycle. This value may be either input by the user or retrieved from memory.

At decision step 246 the microcontroller 12 determines if the reversing switch has been operated by the user. If the reversing switch has been operated, the microcontroller 12 enables the counterclockwise motor 43 at step 248. After the counterclockwise motor 43 has been enabled, or if the reversing switch has not been operated, the microcontroller 12 proceeds to decision step 250. In decision step 250 the microcontroller 12 determines if the present temperature of the load is less than or equal to temperature $T_4$. If this condition is met, and it normally will be when a new load has been placed in the dryer, the microcontroller 12 opens both the high-fire valve and the low-fire valve at step 252. With both the high-fire burner and the low-fire burner on the temperature will begin to increase. At decision step 254 the microcontroller determines if the present temperature of the load is equal to temperature $T_5$. Once that condition is met the microcontroller 12 turns off the high-fire valve at step 256 extinguishing the high-fire burner. This occurs at time $t_1$ shown in FIG. 2. At this point, only the low-fire burner is on.

At decision step 258 the microcontroller 12 determines if the present temperature of the load is greater than or equal to temperature $T_6$. With just the low fire burner on it is possible, as with a very wet load, that the low-fire burner alone will be insufficient to cause the temperature to increase. Thus, at decision step 260 the microcontroller determines if the present temperature of the load has fallen below temperature $T_4$. If that has occurred the microcontroller returns to step 252 wherein the high-fire control valve will be opened thus turning on the high-fire burner. However, if the current temperature of the load has not fallen below the temperature $T_4$, as shown by a negative determination at step 260, that indicates that the low-fire burner alone is sufficient to maintain and eventually increase the temperature of the load. Thus, the microcontroller returns to step 258 to determine when the present temperature of the load is greater than or equal to temperature $T_6$. When that condition is met the microcontroller turns the low-fire burner off at step 262 and the temperature is allowed to fall as shown at time $t_2$ in FIG. 2.

At decision step 264 the microcontroller 12 determines if the present temperature of the load has fallen below or equal to temperature $T_4$. When that condition has been met the microcontroller 12 turns on the low-fire burner at step 66 as shown at time $t_3$ in FIG. 2, decrements the timer at step 268 and interrogates the timer to determine if the predetermined period has ended at decision step 270. If the timer has timed out the predetermined period the modulation cycle has come to an end and the microcontroller 12 proceeds to the next cycle. That next cycle may be a conditioning cycle as shown in FIG. 4 or a drying cycle as shown in FIG. 5. Thus, the microcontroller 12 would proceed from decision step 270 in FIG. 7 to decision step 175 in FIG. 4.

The preheating conditioning cycle shown in FIG. 7 may also be used by itself for drying a load. This is accomplished by loading the timer in step 244 with a sufficient amount of time to enable the modulation cycle to dry the load. In that case, from decision step 270 the microcontroller would proceed to the end routine which was described above in conjunction with FIG. 6. However, when the modulation cycle is used alone, it is possible that the time loaded into the timer will be insufficient and hence the dryer will shut off before the load is dried. It is also possible for the time loaded in the timer to be too long thus causing the dryer to continually operate even though the load has been dried. Thus, it is more advantageous to use the preheating modulation cycle in combination with either the drying or conditioning cycles discussed above.

Figure 8:
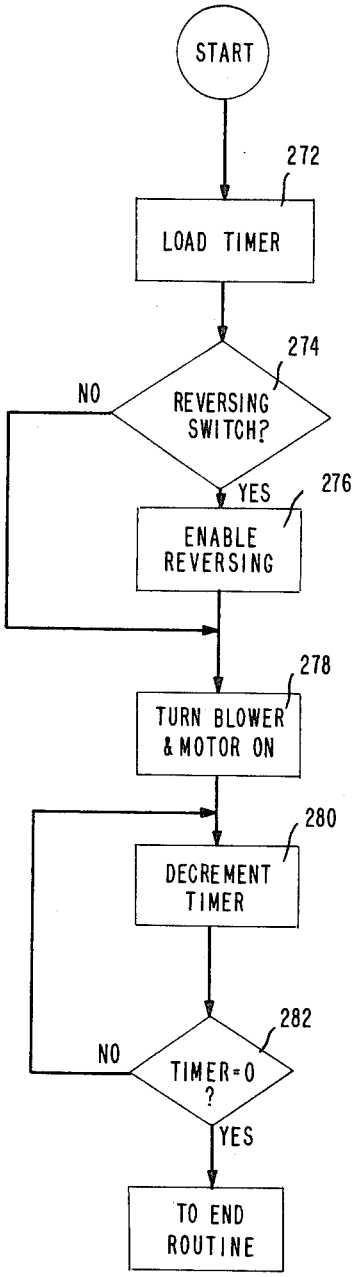
FIG. 8 is a flow chart illustrating the steps of a cooling cycle performed by the automated dryer control system shown in FIG. 1.

Just as the automated dryer control system may be used to dry a load for a predetermined period as discussed above in conjunction with the preheating modulation cycle, the automated dryer control system may be used to cool a load for a predetermined amount of time. A flow chart for such a cooling cycle is illustrated in FIG. 8.

At step 272 a timer is loaded with a value determined by the user or retrieved from memory which will determine the length of the cooling cycle. At decision step 274 the microcontroller determines if the reversing switch has been operated. If the reversing switch has been operated by the user the microcontroller 12 enables the counterclockwise motor 43 at step 276. After the counterclockwise motor 43 has been enabled, or if the reversing switch has not been operated, the microcontroller 12 turns the blower on at step 278. At step 280 the microcontroller 12 decrements the timer and interrogates the timer at decision step 282 to see if the time period for the cooling cycle has lapsed. When the time period for the cooling cycle has elapsed the microcontroller 12 proceeds to the end routine discussed above in conjunction with FIG. 6.

Those skilled in the art will recgonize the flexibility of the automated dryer control system 10 illustrated in FIG. 1. The automated dryer control system may be programmed to perform a variety of cycles or combinations of cycles. It is also anticipated that additional standard programming may be contained in the firmware memory 31 of the microcontroller 12 to enable the microcontroller to provide information to the user such that the desired cycle or combination of cycles can be performed.

For example the microcontroller 12 may be programmed to respond to activation by the key switch 18 such that the microcontroller 12 is in a neutral mode wherein one of the switches, for example the stop switch 17, acts as a selection switch. Successive operations of the stop switch 17 could function to choose one of the following cycles: condition one (load retains 90% moisture content), condition two (load contains 80% moisture content), condition three (load contains 70% moisture content), condition four (load contains 60% moisture content), drying one (one successive scan within repeat range), drying two (two successive scans within repeat range), timed cooling cycle, timed preheating modulation cycle, or programming mode. Once the required mode is selected operation of the start button 16 will cause the microcontroller 12 to commence performance of the selected cycle.

While performing the desired cycle the microcontroller 12 may display pertinent information such as the temperature at which the burners are re-fired, the temperature at which the burners are shut off, the time remaining in a preheating modulation cycle or cooling cycle or the like.

In the programming mode the user may program values for the various parameters suitable for his or her needs such as the temperatures $T_1'$, $T_1$ through $T_6$, the repeat parameter R, the reversing time (the time during which the counterclockwise motor is operated), the dwell time (break time between direction changes), initial direction of rotation (clockwise, counterclockwise), times for the preheating modulation cycle and/or cooling cycle, or desired load condition (percent of two hundred fifty-five counts). Such routine programming of a microcontroller to communicate with various input and output devices for receiving and storing new parameters and for taking actions in response to desired modes of operation of the user is believed to be well within the skills of one of ordinary skill in the art. Nonetheless, a sample program illustrating the instructions for controlling the microcontroller 12 is found in Appendix A to this specification.

While the present invention has been described in connection with an exemplary embodiment thereof, it will be understood that many modifications and variations will be readily apparent to those of ordinary skill in the art. This application is intended to cover those modifications and variations.

What is claimed is:

1. A system for automatically controlling the operation of a dryer, comprising:

means for cyclically applying heat to the load to be dried so that the temperature of the load varies cyclically in a series of cycles including a learn cycle and one or more conditioning cycles subsequent to said learn cycle;

means for determining the time interval for the load to be dried to reach one predetermined temperature from another predetermined temperature during said learn cycle and during each said conditioning cycle;

a source of adjustable frequency clock pulses;

means for adjusting the frequency of said clock pulses so that a predetermined number of clock pulses are produced during a time equal to said time interval determined during said learn cycle;

means for totalizing said clock pulses during the time interval determined during each of said conditioning cycles;

means for comparing said totalized number of clock pulses for each of said conditioning cycles to said predetermined number of clock pulses; and control means for ending the application of heat in response to the occurrence of a predetermined relationship between said totalized number of clock pulses for one of said conditioning cycles and said predetermined number of clock pulses whereby application of heat is ended when the thermal response exhibited by the load in said conditioning cycles bears a predetermined relationship to the thermal response exhibited by the load during said learn cycle.

2. A system according to claim 1, additionally comprising means for periodically producing signals representative of the present temperature of the load to be dried, said means for periodically determining a time interval being responsive to said signals representative of the present temperature of the load.

3. A system according to claim 2, additionally comprising means for providing a plurality of temperature reference signals each being representative of a selected temperature, and second means for comparing said signals representative of the present temperature of the load to be dried to first and second ones of said plurality of temperature reference signals, said means for cyclically applying heat being responsive to said second means for comparing to begin the application of heat to the load when said present temperature is below the selected temperature represented by said first reference temperature signal and to end said application when said present temperature is above the selected temperature represented by said second reference temperature signal.

4. A system according to claim 3, wherein said means for cyclically applying heat includes a large gas jet and a small gas jet, said large gas jet being turned on when said present temperature is below the selected temperature represented by said first reference temperature signal and being turned off when said present temperature is above the selected temperature represented by said second reference temperature signal.

5. A system according to claim 3, additionally comprising means for timing out a predetermined period, said means for cyclically applying heat being responsive to said timing means.

6. A system according to claim 5, wherein a third one of said plurality of temperature reference signals represents a selected temperature greater than said selected temperature represented by said second reference temperature signal, said second means for comparing acting to compare said signals representative of the present temperature of the load to said third temperature reference signal such that said means for applying heat begins the application of heat to the load to be dried when said present temperature is below said selected temperature represented by said second reference temperature signal and ends said application when said present temperature is above said selected temperature represented by said third reference temperature signal while said timing means times out said predetermined period.

7. A system according to claim 1, wherein the dryer additionally comprises a tumbler capable of being rotated in one of two directions, said dryer control system additionally comprising means for determining the present direction of tumber rotation, and means for initiating said periodic production of said time intervals in response to said present direction of tumbler rotation such that said periodic production occurs when the tumbler is rotating in a selected one of said two directions.

8. A system according to claim 1, additionally comprising output means responsive to said control means.

9. A system according to claim 8, wherein said output means further includes a bell.

10. A system as claimed in claim 1 in which said one predetermined temperature is greater than said another predetermined temperature, said means for determining the time interval being operative to determine the time interval during a portion of each said cycle in which the temperature of the load is rising, said control means being operative to end the application of heat when the totalized number of clock pulses for one of said conditioning cycles is equal to or less than a predetermined fraction of said predetermined number of clock pulses.

11. A method for automatically controlling the operation of a dryer, comprising:

cyclically applying heat to the load to be dried so that the temperature of the load varies cyclically in a series of cycles including a learn cycle and one or more conditioning cycles subsequent to said learn cycle;

determining the time interval for the load to be dried to reach one predetermined temperature from another predetermined temperature during said learn cycle and during each of said conditioning cycles;

providing adjustable frequency clock pulses;

adjusting the frequency of said clock pulses so that a predetermined number of clock pulses are produced during a time equal to said time interval determined during said learn cycle;

totalizing said clock pulses during the time interval determined during each of said conditioning cycles;

comparing said totalized number of clock pulses for each of said conditioning cycles to said predetermined number of clock pulses; and ending the application of heat in response to the occurrence of a predetermined relationship between said totalized number of clock pulses for one of said conditioning cycles and said predetermined number of clock pulses, whereby application of heat is ended when the thermal response exhibited by the load in said conditioning cycles bears a predetermined relationship to the thermal response exhibited by the load during said learn cycle.

12. A method according to claim 11, additionally comprising the step of periodically producing signals representative of the present temperature of the load to be dried, said step of periodically determining a time interval being responsive to said signals representative of the present temperature of the load.

13. A method according to claim 12, additionally comprising the step of providing a plurality of temperature reference signals each being representative of a selected temperature, and the second step of comparing said signals representative of the present temperature of the load to be dried to first and second ones of said plurality of temperature reference signals, said application of heat beginning when said present temperature is below the selected temperature represented by said first reference temperature signal and ending when said present temperature is above the selected temperature represented by said second reference temperature signal.

14. A method according to claim 13, additionally comprising the step of timing out a predetermined period, said step of applying heat to the load to be dried being responsive to said predetermined period.

15. A method according to claim 14, wherein a third one of said plurality of temperature reference signals represents a selected temperature greater than said selected temperature represented by said second reference temperature signal, said second step of comparing further including comparing said signal representative of the present temperature of the load to be dried to said third temperature reference signal, said application of heat beginning when said present temperature of the load is below said selected temperature represented by said second reference temperature signal and ending when said present temperature is above said selected temperature represented by said third reference temperature signal while said predetermined period is timed out.

16. A method according to claim 11, additionally comprising the steps of rotating a tumbler in one of two directions, determining the present direction of tumbler rotation, and initiating said periodic production of time intervals in response to said present direction of tumbler rotation such that said periodic production occurs when the tumbler is rotating in a selected one of said two directions.

17. A method as claimed in claim 11 in which said one predetermined temperature is greater than said another predetermined temperature, said time interval is determined during a portion of each said cycle in which heat is applied to the load and the temperature of the load increases, and the application of heat to the load is ended when said totalized number of clock pulses for one of said conditioning cycles is equal to or less than a predetermined fraction of said predetermined number of clock pulses.

18. A method of drying a load comprising the steps of:

(a) cyclically supplying heat to the load so that the temperature of the load varies in a series of cycles including a learn cycle and one or more conditioning cycles subsequent to said learn cycle;

(b) determining a reference rate of temperature variation of the load during a predetermined portion of said learn cycle in which the temperature of the load is increasing through a predetermined temperature range between two predetermined temperatures;

(c) determining a present condition rate of temperature variation during a portion of each of said conditioning cycles corresponding to said predetermined portion of said learn cycle, said portion of each said conditioning cycle being a portion of each said conditioning cycle in which the temperature of the load is increasing through said predetermined temperature range between said two predetermined temperatures;

(d) comparing the present condition rate of temperature variation determined on each of said conditioning cycles with said reference rate of temperature variation; and (e) terminating said heat supplying step when the present condition rate of temperature variation determined on one of said conditioning cycles bears a predetermined relationship to said reference rate of temperature variation, whereby the heat supplying step is terminated when the thermal response of the load exhibited on said conditioning cycles bears a predetermined relationship to the thermal response exhibited by the load during said learn cycle, said reference rate of temperature increase being determined by determining a reference time interval required for the temperature of the load to increase through said predetermined temperature range during said learn cycle and the present condition rate of temperature increase being determined by determining a present condition time interval required for the temperature of the load to increase through said predetermined temperature range on each of said conditioning cycles, said step of comparing said present condition rate of temperature variation with said reference rate of temperature variation including the step of comparing said present condition time interval for each said conditioning cycle with said reference time interval, the method further comprising the step of providing adjustable frequency clock pulses and adjusting the frequency of said clock pulses so that a predetermined number of said clock pulses are produced during a time interval equal to said reference time interval, said step of comparing said present condition time interval with said reference time interval being performed by totalizing the number of said clock pulses as the temperature of the load increases through said predetermined temperature range on each said conditioning cycle and comparing the totalized number of clock pulses for with said predetermined number of clock pulses.

19. A method as claimed in claim 18 in which said heat supplying step is terminated when the number of said clock pulses totalized on one of said conditioning cycles is less than or equal to a predetermined fraction of said predetermined number of clock pulses.

20. A method of drying a load comprising the steps of:

(a) cyclically supplying heat to the load so that the temperature of the load varies in a series of cycles including a learn cycle and one or more conditioning cycles subsequent to said learn cycle;

(b) determining a reference rate of temperature variation of the load during a predetermined portion of said learn cycle in which the temperature of the load is increasing through a predetermined temperature range between two predetermined temperatures;

(c) determining a present condition rate of temperature variation during a portion of each of said conditioning cycles corresponding to said predetermined portion of said learn cycle, said portion of each said conditioning cycle being a portion of each said conditioning cycle in which the temperature of the load is increasing through said predetermined temperature range between said two predetermined temperatures;

(d) comparing the present condition rate of temperature variation determined on each of said conditioning cycles with said reference rate of temperature variation; and (e) terminating said heat supplying step when the present condition rate of temperature variation determined on one of said conditioning cycles bears a predetermined relationship to said reference rate of temperature variation, whereby the heat supplying step is terminated when the thermal response of the load exhibited on said conditioning cycles bears a predetermined relationship to the thermal response exhibited by the load during said learn cycle, the method further comprising the step of maintaining the temperature of the load within a modulation range of temperatures above said predetermined temperature range subsequent to said learn cycle but prior to the last one of said conditioning cycles.

21. A method of drying a load comprising the steps of:

(a) cyclically supplying heat to the load so that the temperature of the load varies in a series of cycles including a learn cycle and one or more conditioning cycles subsequent to said learn cycle;

(b) determining a reference rate of temperature variation of the load during a predetermined portion of said learn cycle in which the temperature of the load is increasing through a predetermined temperature range between two predetermined temperatures;

(c) determining a present condition rate of temperature variation during a portion of each of said conditioning cycles corresponding to said predetermined portion of said learn cycle, said portion of each said conditioning cycle being a portion of each said conditioning cycle in which the temperature of the load is increasing through said predetermined temperature range between said two predetermined temperatures;

(d) comparing the present condition rate of temperature variation determined on each of said conditioning cycles with said reference rate of temperature variation; and (e) terminating said heat supplying step when the present condition rate of temperature variation determined on one of said conditioning cycles bears a predetermined relationship to said reference rate of temperature variation, whereby the heat supplying step is terminated when the thermal response of the load exhibited on said conditioning cycles bears a predetermined relationship to the thermal response exhibited by the load during said learn cycle, the method further comprising the step of maintaining the temperature of said load in a modulation range of temperatures above said predetermined temperature range prior to said learn cycle.

22. A method of drying a load to substantially complete dryness comprising the steps of:

(a) cyclically supplying heat to said load so that the temperature of said load varies cyclically;

(b) determining the rate of temperature variation of the load during a predetermined portion of each cycle by providing clock pulses and totalizing the number of clock pulses occurring while the temperature of the load increases through a predetermined range of temperatures;

(c) comparing the rates determined on successive ones of said cycles by comparing the number of said clock pulses totalized on said successive cycles; and (d) adding one to a value stored in a counter when the numbers of said clock pulses totalized on consecutive ones of said cycles differ from one another by less than a predetermined repeat parameter and resetting said value to zero whenever the numbers of clock pulses totalized on consecutive ones of said cycles differ from one another by more than said repeat parameter; and (e) terminating said heat supplying step when the value stored in said counter reaches a predetermined value, whereby said heat supplying step is terminated when the rates of temperature variation determined measured during consecutive ones of said cycles differ from one another by less than a predetermined amount.

23. A method as claimed in claim 22 in which said predetermined value is two or more.

24. A control system for controlling operation of a dryer having a heat source comprising:

(a) means for cyclically actuating said heat source so that the temperature of the load to be dried varies in a series of cycles including a learn cycle and one or more conditioning cycles subsequent to said learn cycle;

(b) rate-determining means for determining a reference rate of temperature variation of the load during a predetermined portion of said learn cycle and determining a present condition rate of temperature variation during a portion of each of said conditioning cycles corresponding to said predetermined portion of said learn cycle;

(c) comparison means for comparing said present condition rate of temperature variation determined on each of said conditioning cycles with said reference rate of temperature variation; and (d) control means for terminating operation of said heat source when the present condition rate of temperature variation determined on one of said conditioning cycles bears a predetermined relationship to said reference rate of temperature variation, whereby operation of said heat source is terminated when the thermal response of the load exhibited on said conditioning cycles bears a predetermined relationship to the thermal response exhibited by the load during said learn cycle, said rate-determining means including means for determining a reference time interval required for the temperature of the load to increase through a predetermined temperature range between two predetermined temperatures during said learn cycle and means for determining a present condition time interval required for the temperature of the load to increase through said predetermined temperature range between said two predetermined temperatures on each of said conditioning cycles, said comparison means including time-comparing means for comparing the present condition time interval for each conditioning cycle with said reference time interval, said time-comparing means including means for providing adjustable frequency clock pulses and means for adjusting the frequency of said clock pulses so that a predetermined number of said clock pulses are produced during a time interval equal to said reference time interval, means for totalizing the number of said clock pulses as the temperature of the load increases through said predetermined temperature range on each said conditioning cycle and means for comparing the totalized number of clock pulses for with said predetermined number of clock pulses.

25. A control system as claimed in claim 24 in which said control means is operative to terminate operation of said heat source when the number of said clock pulses totalized on one of said conditioning cycles is less than or equal to a predetermined fraction of said predetermined number of clock pulses.

26. A control system for controlling a dryer having a heat source to dry a load to substantially complete dryness comprising:

(a) means for cyclically actuating said heat source so that the temperature of said load varies cyclically;

(b) rate-determining means for determining the rate of temperature variation of the load during a predetermined portion of each said cycle;

(c) comparison means for comparing the rates determined on consecutive ones of said cycles; and (d) control means terminating of said heat source when the rates measured during consecutive ones of said cycles differ from one another by less than a predetermined amount, said rate determining means including a source of clock pulses, said comparision means including means for totalizing the number of clock pulses occurring while the temperature of the load increases through a predetermined range of temperatures and comparing the number of said clock pulses totalized on consecutive ones of said cycles, said control means including a counter, incrementing means for adding one to a value stored in said counter when the numbers of clock pulses totalized on consecutive ones of said cycles differ from one another by less than a predetermined repeat parameter, reset means for resetting said value to zero whenever the numbers of clock pulses totalized on consecutive ones of said cycles differ from one another by more than said predetermined repeat parameter, and means for terminating operation of said heat source when said value reaches a predetermined value.

27. A control system as claimed in claim 26 in which said predetermined value is two or more.

* * * * *